US005807098A

United States Patent [19]

Deng

[11] Patent Number: 5,807,098

[45] Date of Patent: Sep. 15, 1998

[54] GAS HEATER WITH ALARM SYSTEM

[75] Inventor: David Deng, Rowland Heights, Calif.

[73] Assignee: Desa International, Inc., Bowling Green, Ky.

[21] Appl. No.: 638,134

[22] Filed: Apr. 26, 1996

[51] Int. Cl.[6] ..... F27B 1/26; F23N 5/00; G08B 17/10; F24H 3/00

[52] U.S. Cl. ..... 432/36; 431/76; 126/112; 340/632

[58] Field of Search ..... 431/76; 432/36; 340/632; 126/112

[56] References Cited

U.S. PATENT DOCUMENTS

| | | | |
|---|---|---|---|
| 4,032,286 | 6/1977 | Kobayashi et al. | 431/76 |
| 4,406,613 | 9/1983 | Naito et al. | 431/76 |
| 4,794,908 | 1/1989 | Hall | 126/112 |
| 4,893,113 | 1/1990 | Park et al. | 340/632 |
| 5,276,434 | 1/1994 | Brooks et al. | 340/632 |
| 5,470,018 | 11/1995 | Smith . | |

*Primary Examiner*—Christopher Kilner
*Attorney, Agent, or Firm*—Oppenheimer Wolff & Donnelly LLP

[57] ABSTRACT

A heater including a housing, a heating assembly having a burner, and at least one of an oxygen level detection assembly adapted to distinguish between a relatively normal oxygen level, a relatively low oxygen level and relatively unsafe oxygen, a carbon monoxide sensor and a combustible gas sensor. The heater may also include an indicator adapted to produce at least one of an audible indication and a visible indication in response to a detection of a relatively low oxygen level, a detection of a predetermined level of carbon monoxide, or a detection of combustible gas.

29 Claims, 6 Drawing Sheets

FIG. 4A
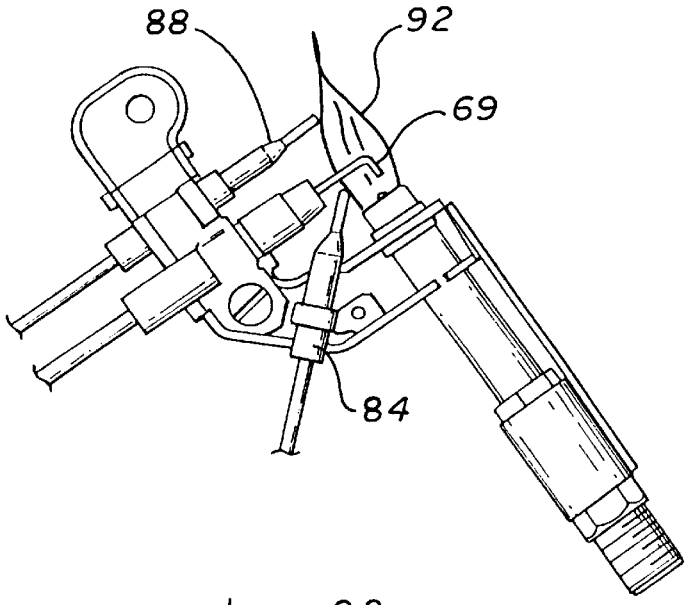
FIG. 4B
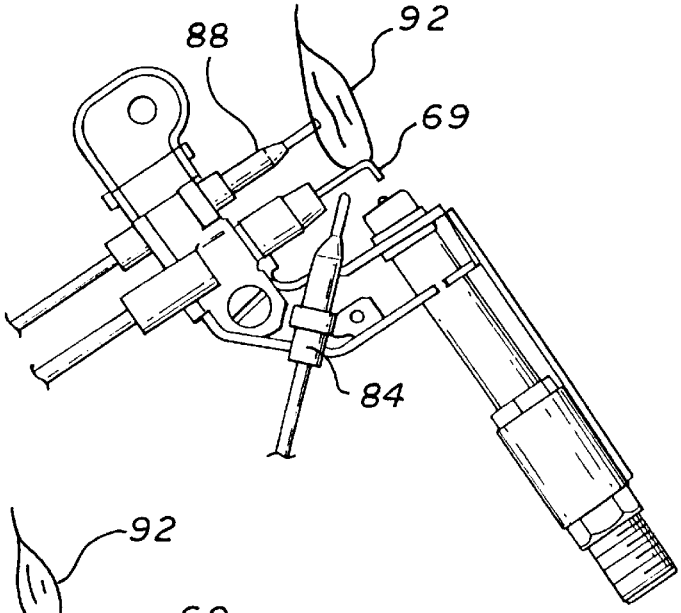
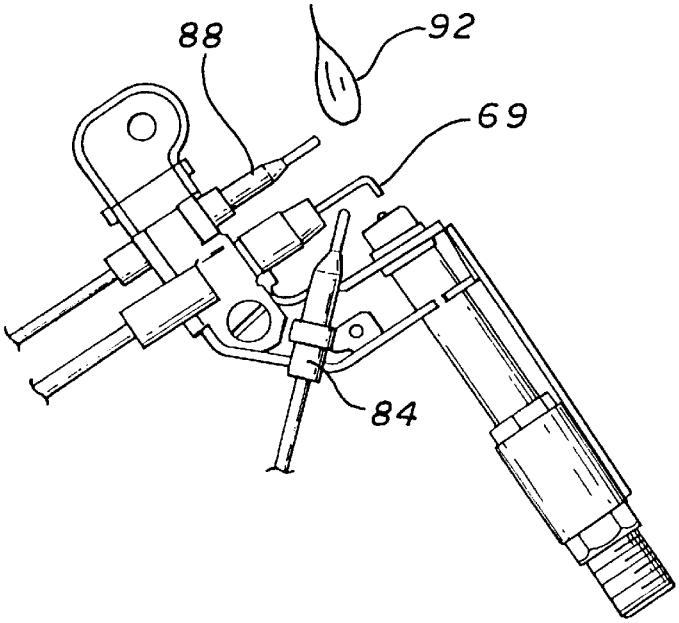
FIG. 4C

GAS HEATER WITH ALARM SYSTEM

BACKGROUND OF THE INVENTION

1. Field of Invention

The present invention relates generally to gas heaters and, more particularly, to unvented gas heaters.

2. Description of the Related Art

Gas heaters include one or more heating elements. The heating elements are typically in the form of ceramic plaques. A gaseous air/fuel mixture is burned on the surface of the ceramic plaques which, in turn, radiate heat. Examples of such gas heaters include the GLO-WARM unvented propane gas heater and the GLO-WARM blue flame unvented natural gas heater, both of which are manufactured UNIVERSAL HEATING, INC., located at 3830 Prospect Avenue, Yorba Linda, Calif. 92686, and the assignee of the present application. Unvented gas heaters are designed to be used indoors without pipes or other conduit to vent the heater's exhaust to the atmosphere.

The level of oxygen in the air is typically about 20.9%. It is important that the oxygen level in a room in which an unvented heater is used remain at or near 20.9%, both for proper combustion and safety purposes. An adequate supply of fresh air will maintain the oxygen level at or near the desired level. In buildings with loose structures, such as houses made of wood, an adequate supply of fresh air will enter via wall spaces as well as door and window frames. Other buildings are more tightly sealed. Here, steps should be taken to insure that fresh air is supplied.

Heater users sometimes operate unvented gas heaters in rooms which do not receive an adequate supply of fresh air. Thus, for safety purposes, many unvented heaters include an oxygen depletion sensor (ODS) system which will shut off the heater when the oxygen level in the air drops below a predetermined "unsafe" level (typically about 18%). More specifically, when the oxygen level drops to 18%, the flow of gas to the pilot and burner of the heater will be automatically shut off.

Although unvented heaters with ODS systems are generally quite useful, the inventor herein has determined that there are many disadvantages associated with their use and installation. For example, ODS systems of the type presently know in the art simply turn off the pilot and burner when the oxygen level drops below the predetermined "unsafe" level. If the user fails to properly adjust the doors and windows, the first indication that the ODS system has caused the heater to stop producing heat is typically the cold sensation caused by a drop in room temperature. Other disadvantages are associated with improper installation, which often results in fuel leakage and other unsafe conditions. Combustible gas leaks pose severe hazards to persons and property. Unfortunately, such leakage normally goes undiscovered until the user of the heater, or another person, smells gas. Another disadvantage associated with unvented gas heaters is the production of carbon monoxide gas. The level of carbon monoxide in the air can rise to dangerous levels in environments that do not receive an adequate supply of fresh air.

SUMMARY OF THE INVENTION

The general object of the present invention is to provide a gas heater which substantially obviates, for practical purposes, the aforementioned problems in the art.

More specifically, one object of the present invention is to provide a gas heater which will provide a warning before it stops producing heat in response to a drop in oxygen level.

In accordance with one embodiment of the present invention, this objective is accomplished by providing a heater which is capable of determining when the oxygen level has dropped to a level that is below normal, but above the "unsafe" level. The present heater is also capable of conveying this information to the user before the oxygen level reaches the "unsafe" level. The oxygen level information may be conveyed audibly, visibly, both audibly and visibly, or by other means. This embodiment of the present invention provides a number of advantages over presently known gas heaters. For example, the early warning provided by this embodiment of the invention will allow the user to take any necessary steps, such as slightly opening a widow, to insure that there is a proper supply of fresh air and that the oxygen level will remain at an acceptable level.

Another object of the present invention is provide a heater which is less likely than prior heaters to remain in an improperly installed state or in any other state that results in fuel leakage. In accordance with another embodiment of the invention, this objective is accomplished by providing a heater that is capable of sensing fuel leaks and conveying this information to the user. The fuel leak information may be conveyed audibly, visibly, both audibly and visibly, or by other means. As a result, this embodiment is capable of warning the user when a fuel leak occurs, whether the fuel leak is due to improper installation, jolting of the heater, normal wear and tear, or any other circumstances that could result in a leak.

Still another object of the present invention is to prevent the level of carbon monoxide in the room in which a heater is operating from reaching an unacceptable level. In accordance with still another embodiment of the invention, this objective is accomplished by providing a heater which is capable of determining when the carbon monoxide level has reached an unacceptable level. The present heater is also capable of conveying this information to the user. The carbon monoxide level information may be conveyed audibly, visibly, both audibly and visibly, or by other means. This aspect of the present invention provides a number of advantages over prior heaters. For example, it will allow the user to take the necessary steps, such as slightly opening a widow, to insure that the carbon monoxide in the air will remain at an acceptable level.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of the preferred embodiments of the invention will be made with reference to the accompanying drawings.

FIGS. 4*a*–4*c* are representations of flame progression in accordance with the pilot and oxygen level detection system shown in FIGS. 3*a* and 3*b*.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. The scope of the invention is defined by the appended claims.

Figure 1:
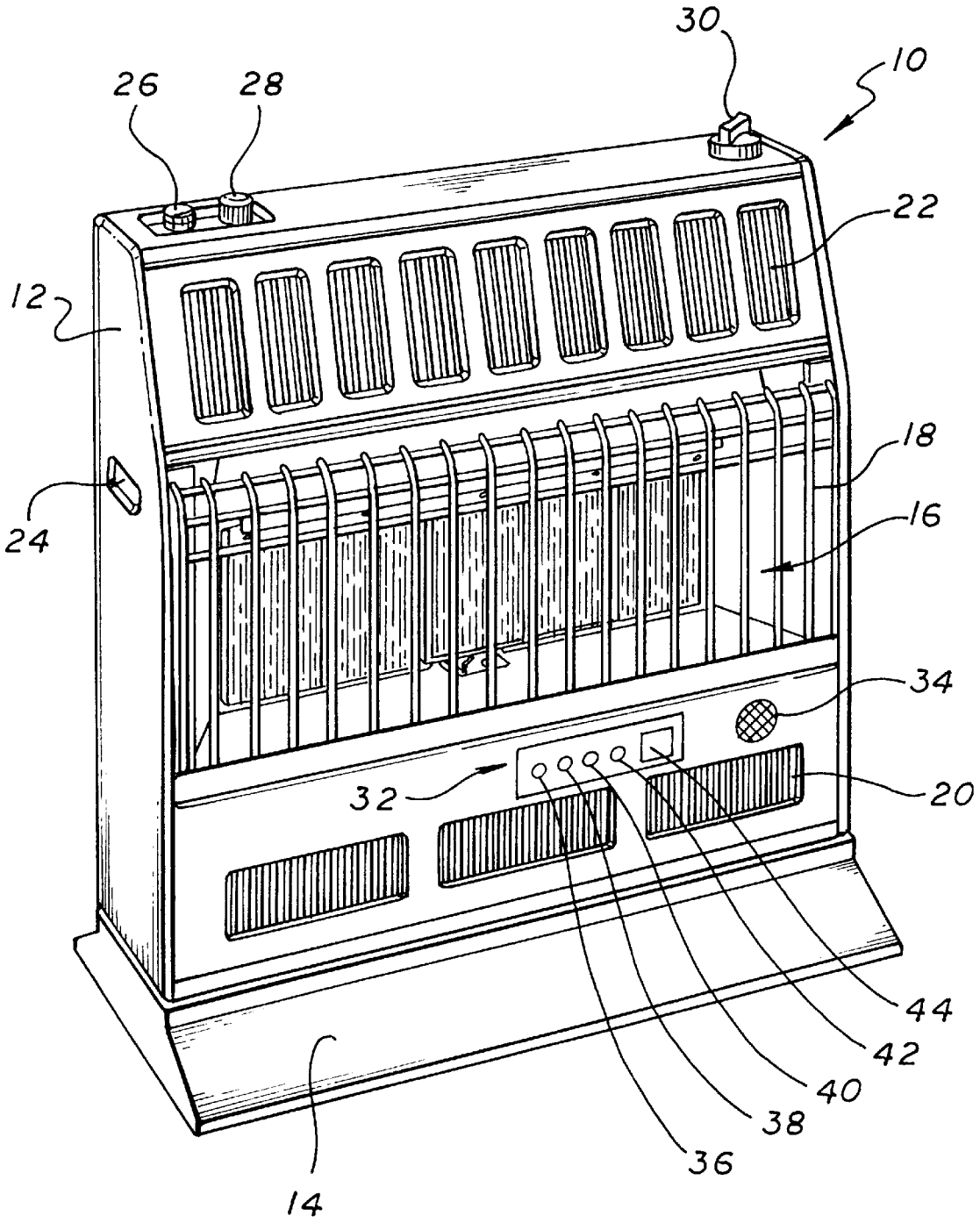
FIG. 1 is a perspective view of the housing of an unvented heater in accordance with a preferred embodiment of the present invention.

An exemplary heater in accordance with a preferred embodiment of the present invention is shown in FIG. 1. Such a heater may be fueled by natural gas, propane gas or other appropriate fuels. Although the exemplary embodiments shown in FIGS. 1–6 relate to unvented gas heaters, it is to be understood that the present invention need not be limited to this variety of heater. Referring to the numbered elements in FIG. 1, the exemplary unvented heater 10 includes a heating assembly housing 12 mounted on a base 14. The housing 12 includes a heating chamber 16. The heating chamber 16, which contains a plurality of heat emitting infrared burner plaques, is covered by a grill 18. The housing 12 also includes a plurality of air circulation vents 20, 21 (see FIG. 5) and 22, as well as a pair of handles 24. Air enters the housing through vents 20 and 21 and exits through the heating chamber grill 18 and the vent 22.

The heater controls are located on the top portion of the housing 12. In the exemplary embodiment, these controls include an ignition knob 26, a temperature setting knob 28 that is used when the heater is in the thermostatic control mode, and a burner control knob 30 that is used to select the number of burners to which fuel will be supplied. The exemplary ignition knob 26 includes OFF, IGNITE, PILOT and ON settings. The temperature setting knob 28 includes a plurality of numbered settings, each corresponding to a desired amount of heat output. The housing 12 also includes various warning indicators. The exemplary warning indicators consist of a display panel 32 and a loud speaker 34. The display panel 32 includes three lights (numbered 36, 38 and 40), a test/reset button 42 and a numerical display 44. The respective functions and operations of the speaker, lights, test/reset button and numerical display are discussed in greater detail below.

Figure 2A:
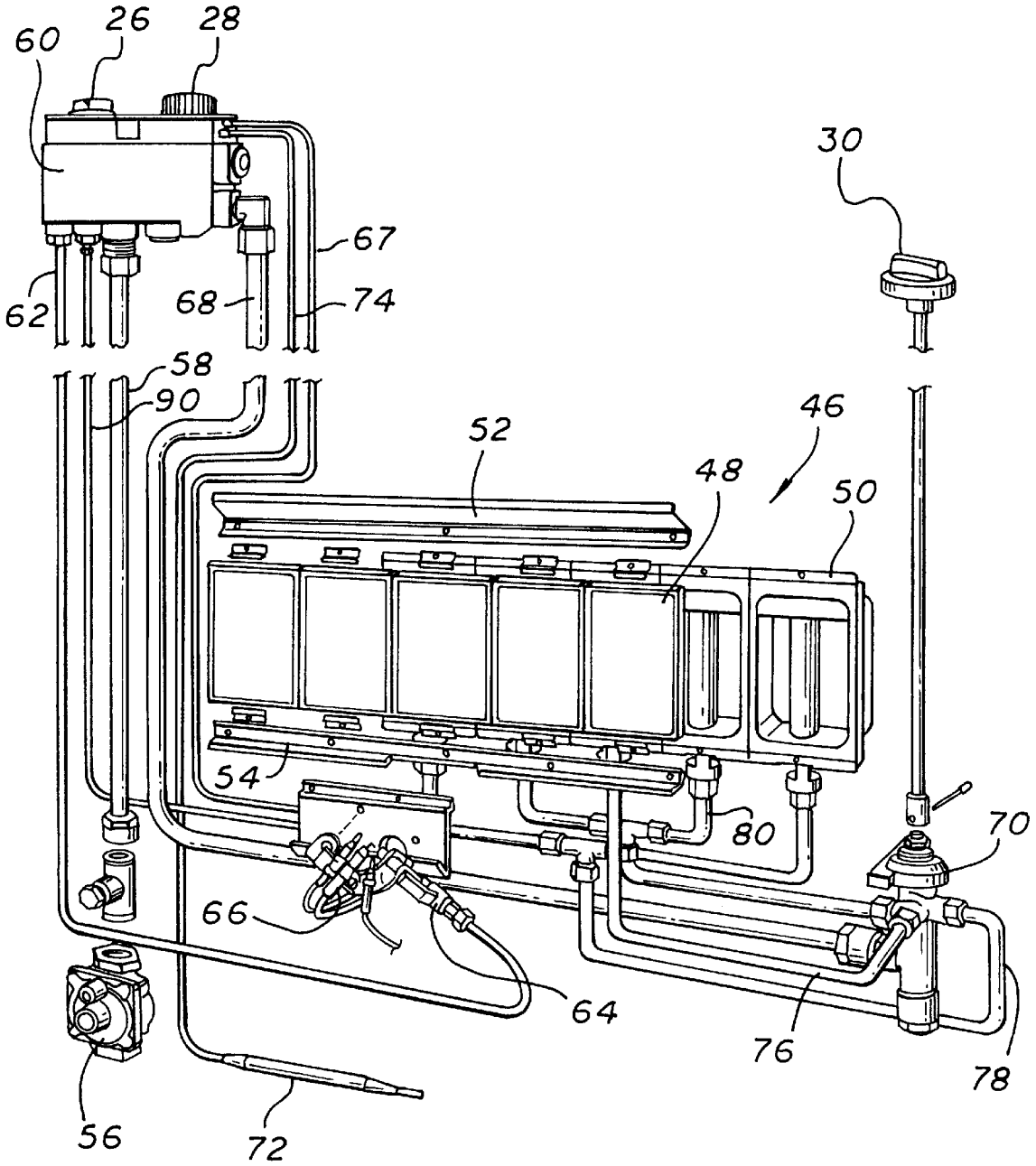
FIG. 2*a* is a partially exploded view of a propane gas heating assembly that may be used in conjunction with the housing shown in FIG. 1.

As shown by way of example in FIG. 2*a*, a propane gas-fueled heating assembly that may be used in conjunction with the housing 12 shown in FIG. 1 includes five burners 46, each of which consists of an infrared ceramic plaque 48 that is secured to a corresponding burner box 50. The number of burners may, however, be increased or decreased to suit particular applications. An upper burner deflector 52 and lower burner deflector bracket 54 are also shown. Propane gas is supplied to the burners and to a pilot system in the following manner. The gas enters the heating assembly through a pressure regulator 56 and an inlet pipe 58. From there, it enters a thermostat control valve 60 such as, for example, the control valve sold under model number GV30-B3A2A8C, by Mertik Maxitrol, located in Quedlinburg, Germany. No gas will pass beyond the control valve 60 when the ignition knob 26 is set to the OFF mode. To place the heater in the pilot mode, the ignition knob 26 is moved from the from the OFF position, past the IGNITE position to the PILOT position. The thermostat control valve 60 will allow gas to pass through a gas line 62 to a pilot 64. The longitudinal end surface of the pilot includes a small nozzle. An ignitor 66, which is connected to the control valve 60 by a wire 67, ignites the gas and a pilot flame is formed. The pilot and ignitor are discussed in greater detail below in conjunction with the present invention's oxygen level detecting capabilities.

After the pilot flame is lit, the thermostat control valve 60 will supply gas to the burners through a gas line 68 and a gas control valve 70. The amount of gas supplied to the burners is mechanically regulated by the thermostat control valve 60 and is equal to that necessary to maintain the temperature specified by the temperature setting knob 28. The temperature is monitored by a thermocouple 72 which is connected to the thermostat control valve 60 by a line 74. The burner control knob 30 in the exemplary embodiment has five settings, OFF, PILOT/IGNITE, LOW, MEDIUM and HIGH, each of which corresponds to a control valve 70 state. No gas is supplied to the burners by the control valve 70 when the control knob 30 is set to OFF or PILOT/IGNITE. When the control knob 30 is set to LOW, MEDIUM or HIGH, gas will be supplied to one, three or five of the burners, respectively, through gas lines 76, 78 and 80.

It should be noted that if, for example, a three burner design is employed, then the corresponding progression could be one, two or three burners. It should also be noted that heaters in accordance with the present invention may also be configured in such a manner that the burner control knob 30 and control valve 70 are both eliminated. When such a configuration is employed, all of the burners will be used whenever the heater is in operation and the amount of gas supplied to the burners will be controlled by the thermostat control valve. Ignition functions may be handled by an ignition switch.

Figures 2B, 6:
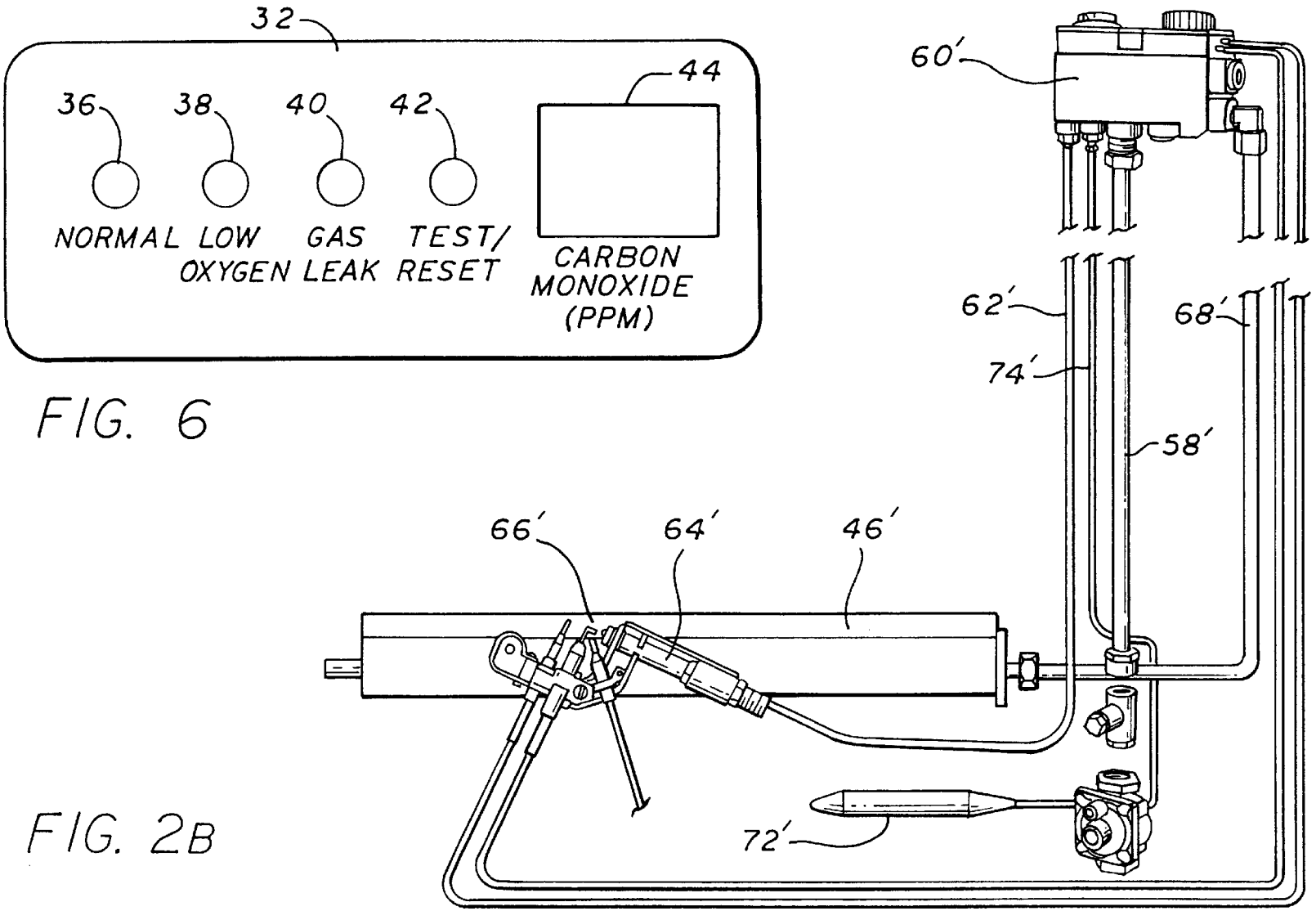
FIG. 2*b* is a partially exploded view of a blue-flame type natural gas heating assembly that may be used in conjunction with the housing shown in FIG. 1.
FIG. 6 is a front view of an exemplary display panel.

An exemplary natural gas-fueled heating assembly is shown in FIG. 2*b*. More specifically, a blue-flame type heating assembly has been used as the exemplary natural gas heating assembly. The natural gas heating assembly may be used in conjunction with a slightly modified version of the housing shown in FIG. 1. Such modifications are well within the purview of those of ordinary skill in the art and, therefore, will not be discussed here. The exemplary natural gas-fueled assembly is similar to the propane gas-fueled assembly described above in that it includes a thermostat control valve 60' which receives gas from an inlet pipe 58' and pressure regulator 56'. The desired temperature may be set with a control knob 28' and the actual temperature may be monitored by a thermocouple 72'. The thermocouple 72' is connected to the thermostat control valve 60' by a wire 74'. The thermostat control valve 60' will, in turn, regulate the flow of gas to the natural gas burner 46' through pipe 68'. Gas is also supplied through a pipe 62' to a pilot 64'. The pilot flame is lit by an ignitor 66'.

Oxygen Level Detecting

Figure 3A:
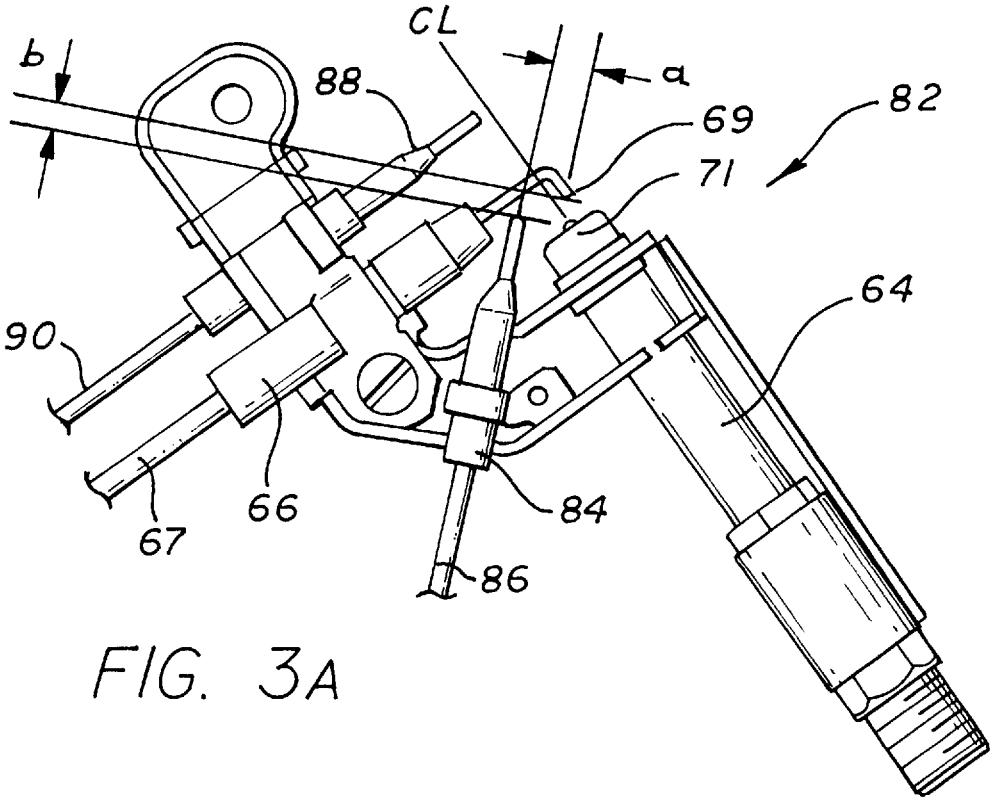
FIG. 3*a* is a side view of a pilot and oxygen level detection system in accordance with one embodiment of the present invention.

Referring now to FIG. 3*a*, a propane gas pilot system 82 in accordance with the present invention includes the aforementioned pilot 64, having a nozzle 71, and the ignitor 66. The ignitor includes an L-shaped electrode 69. An oxygen level detection system is also provided. The present oxygen level detection system includes a first thermocouple 84 which is used to determine when the oxygen level reaches a "low" level (19.0 to 19.2%). The first thermocouple 84 supplies a predetermined voltage to an early warning device (described in detail below with respect to FIG. 5) via a wire 86 when in contact with, or substantially close to, the pilot flame. The early warning device will cause an audible and/or visible "low" oxygen level signal to be produced if this voltage drops. The present oxygen detection system may also include a second thermocouple 88 which is connected to the thermostat control valve 60 by a wire 90. The second thermocouple 88 is used to determine when the oxygen level reaches an "unsafe" level (18.5 to 18.7%) or below. When in contact with or substantially close to the pilot flame, the second thermocouple 88 supplies a predetermined voltage to the thermostat control valve 60. If this voltage is not supplied, the supply of gas to the burners and pilot will be shut off. The effect of dropping oxygen levels and the corresponding operation of the present oxygen detection system will now be described with reference to FIGS. 4*a*–4*c*.

In FIG. 4*a*, the propane gas pilot system 82 is shown operating under "normal" oxygen level conditions (oxygen level greater than or equal to 21%). Here, the flame 92 extends from the pilot 64 through the L-shaped electrode 69 and is in contact with the first thermocouple 84 and the second thermocouple 88. Sufficient voltage will be supplied to both the thermostat control valve 60 and the early warning device. As a result, the early warning device will not cause a "low" oxygen level signal to be produced and the thermostat control valve 60 will not shut off the supply of gas to the burners and pilot.

When the oxygen level drops to a "low" level (19.0 to 19.2%), the flame 92 will move to the position in contact with, or just above, the L-shaped electrode 69 shown in FIG. 4*b*. The flame 92 is no longer in contact with or substantially close to the first thermocouple 84 and, as a result, the temperature of first thermocouple will drop, as does the voltage produced thereby. When the voltage drops to a predetermined level (such as 3 mV), the early warning device will initiate the "low" oxygen level signal. Users will be warned in the manner described below that the oxygen level has dropped and, if this continues, that the heater will turn itself off. The flame 92 will continue to contact the second thermocouple 88, thereby preventing fuel shut-off by the thermostat control valve 60. Under normal conditions in a typically-sized room, the flame will remain in this location for approximately 8–15 minutes and the user will have plenty of time to take appropriate action, such as opening a window, to raise the oxygen level.

The shape and location of the L-shaped electrode 69 plays a substantial role in maintaining a steady flame in the location shown in FIG. 4*b*. This electrode reduces the speed of gas flow and increases the duration of gas/air mixing, as well as the effectiveness of the mixing. When prior electrodes, such as those which are substantially S-shaped, are used and the oxygen level is "low," the flame tends to jump around, from the position shown in FIG. 4*a* to the position shown in FIG. 4*b*. Such flame movement prevents accurate "low" oxygen level detection.

Once the oxygen level drops to an "unsafe" level (18.5 to 18.7%) or below, the flame 92 will move to location shown in FIG. 4*c*. Here, the flame is not in contact with or substantially close to either thermocouple and, as a result, the temperature of the second thermocouple 88 will also drop, as will the voltage produced thereby. The supply of gas to the burners and the pilot will then be cut off by the thermostat control valve 60.

The progression described above should be distinguished from those instances where the heater is merely turned off. When the heater is turned off, the flame will move through the sequence shown in FIGS. 4*a* to 4*c* and then completely disappear in a matter of seconds. No "low" oxygen level signals will be provided when the heater is merely turned off.

In order to insure that the flame 92 moves in the manner described above with respect to FIGS. 4*a* –4*c*, the preferred embodiments rely on a predetermined relationship between the nozzle diameter of the pilot 64, the fuel pressure, the distance of the electrode 69 from the pilot nozzle as well as the location of the L-shaped electrode relative to the nozzle centerline, and the level of oxygen in the air. Referring first to the preferred pilot and oxygen level detection system shown in FIG. 3*a*, which may be used in conjunction with a propane gas heater, the diameter of the pilot nozzle 71 is approximately 0.23 mm (±0.005 mm) and the gas pressure is between 8 and 11 inches of mercury. The downwardly extending portion of the L-shaped electrode 69 is offset with respect to the centerline CL of the pilot nozzle 71 by 3.00 mm and is spaced approximately 3.50 mm from the nozzle. The second thermocouple 88 is positioned such that its tip is approximately 18.25 mm from the nozzle. With respect to the position of the first thermocouple 84 relative to the electrode 69, distance "a" is approximately 4.00 mm and distance "b" is approximately 2.60 mm. So configured, the propane gas embodiment will provide a warning time of approximately 8–15 minutes in a typical room. In other words, the flame 92 will remain in the position shown in FIG. 4*b* for approximately 8–15 minutes.

Figure 3B:
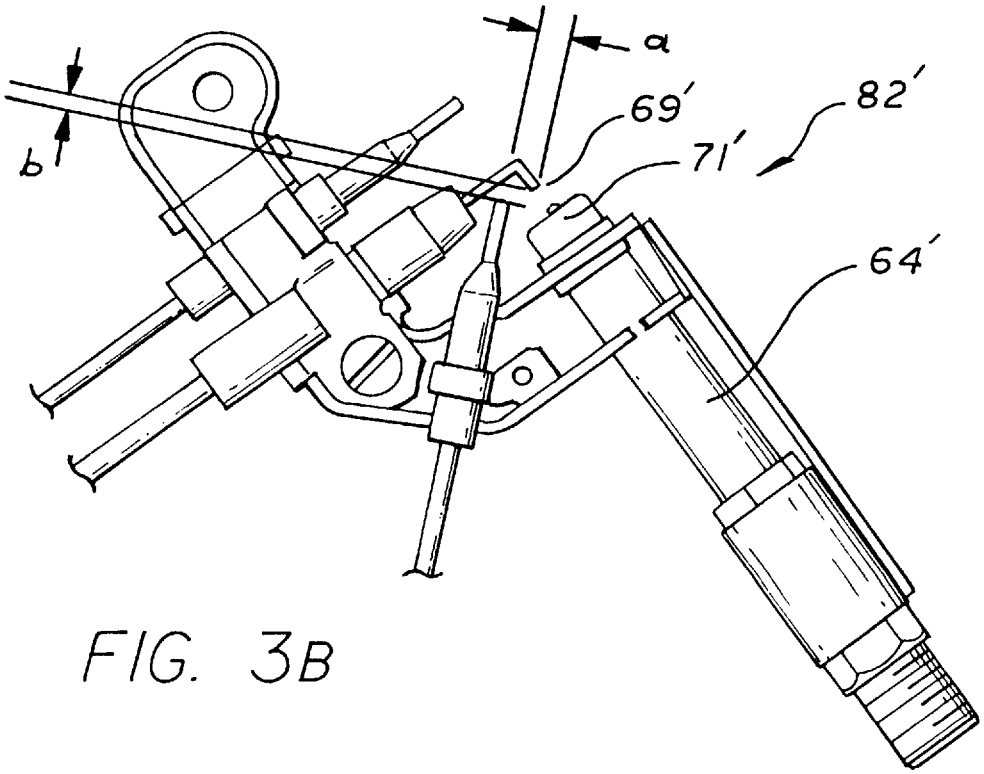
FIG. 3*b* is a side view of a pilot and oxygen level detection system in accordance with another embodiment of the present invention.

The second preferred pilot and oxygen detection system, which is shown in FIG. 3*b*, may be used in conjunction with a natural gas heater (see the exemplary natural gas heater shown in FIG. 2*b*). The embodiment shown in FIG. 3*b* is substantially similar to that shown in FIG. 3*a*. However, there are a few differences necessitated by the differences in the manners in which the respective fuels burn and the properties thereof. For example, natural gas has a lower caloric value and its flame length is longer than propane. In the natural gas embodiment, the pilot 64' has a nozzle 71' diameter of approximately 0.46 mm (±0.01 mm) and the gas pressure is approximately 3 inches of mercury. The downwardly extending portion of the electrode 69' is centered with respect to the nozzle of pilot 64' and is spaced approximately 4.20 mm from the nozzle. In addition, distance "a" is approximately 4.25 mm. So configured, the natural gas embodiment will provide the same warning time (approximately 8–15 minutes) as the propane gas embodiment.

Carbon Monoxide and Combustible Gas Leakage Detecting

Figure 5:
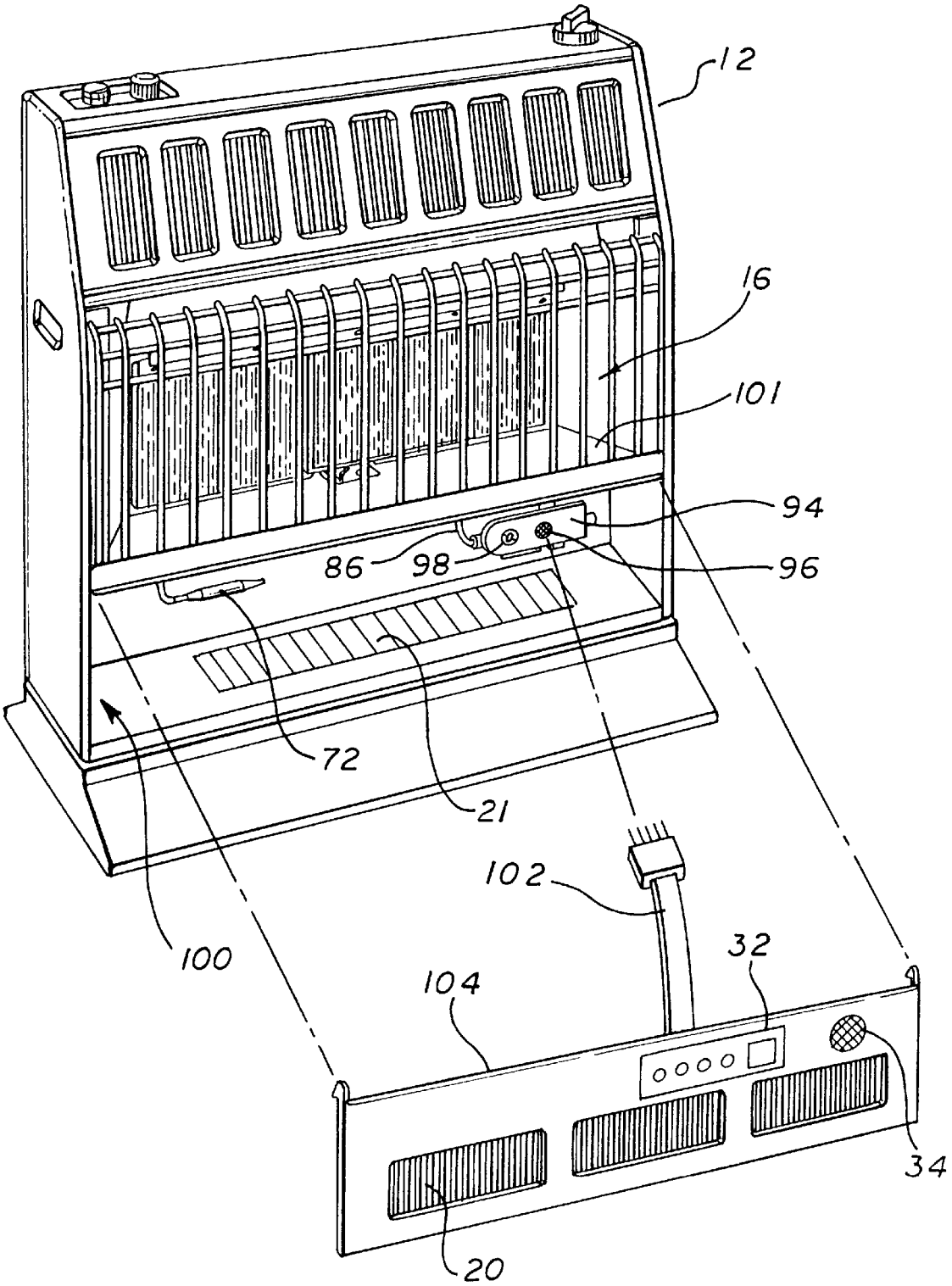
FIG. 5 is a partially exploded perspective view of the unvented heater shown in FIG. 1.

As illustrated in FIG. 5, an exemplary early warning device 94 may include a carbon monoxide sensor 96 and a gas detection sensor 98. If so desired, the sensors may be protected by an insulating material which will not substantially effect their sensing capabilities. Turning first to the carbon monoxide sensor 96, a suitable sensor is the QM-B thick film gas sensor produced by the Hefei Institute of Intelligent Machines in Hefei, China. The exemplary carbon monoxide sensor 96 sensor will produce an alert signal in response to one or more of the following situations: (1) the level of carbon monoxide in the air remains between 100 ppm and 200 ppm for 60 minutes; (2) the level of carbon monoxide in the air remains between 200 ppm and 300 ppm for 30 minutes; and (3) the level of carbon monoxide in the air reaches or exceeds 300 ppm. After the alert signal is produced, the early warning device 94 will apply a 5 V clear signal to the sensor to return it to its normal state. The carbon monoxide sensor also produces a signal indicative of the level of carbon monoxide in the air (measured in ppm).

A suitable gas detection sensor 98 is the QM-B2 thick film gas sensor produced by the Hefei Institute. Such a sensor will detect most combustible gases, such as natural gas, propane gas, smoke, and oil gas, and produce an alert signal in response thereto. As discussed above, gas leaks may result from a variety of circumstances including, but not limited to, improper installation and use.

The location of the carbon monoxide sensor 96 and gas detection sensor 98 within the housing 12 is also noteworthy. As shown in FIG. 5, these sensors are mounted within a lower compartment 100 that is associated with the air inlet vents 20 and 21. The lower compartment 100 is substantially separated from the heating chamber 16 by a burner deflector plate 101. The deflector plate 101 is spaced apart from the burners in such a manner that a passage for letting air flow from the lower compartment 100 to the heating chamber 16 is formed. Although not visible here, an upper deflector plate is also included and is spaced from the burners so that heat will be able to escape from the housing through the vent 22.

There are a number of advantages associated with this configuration. For example, the temperature within this compartment will normally remain close to room temperature. [Note that the temperature sensing thermocouple 72 is also located here.] This is important because the environment in which the sensors are used should remain between −10° C. and 40° C. In addition, by virtue of their close proximity to the inlet vents 20 and 21, the sensors will be sampling air which is representative of that within the room.

Finally, although the respective lower portions of the heating assemblies shown in FIGS. 2*a* and 2*b* could, in some instances, be visible in FIG. 5, they have not been shown in order to expose other aspects of the present invention.

Early Warning Indicators

As shown in FIG. 5, the early warning device 94 may, in addition to having the carbon monoxide sensor 96 and the gas detection sensor 98 mounted thereon, also be connected to the first thermocouple 84 by a wire 86. Suitable circuitry is provided so that the early warning device 94 will transmit a number of signals via a ribbon cable 102 to the display panel 32 and to the loud speaker 34, both of which are mounted on a panel 104. Referring to the exemplary display panel 32 shown in FIG. 6, the display panel includes a green light 36 which is indicative of normal operation, a yellow light 38 which is indicative of a "low" oxygen level in the room, and a red light 40 which is indicative of a gas leak. The display panel 32 may also include a test/reset button 42 and a numerical display 44 which displays the carbon monoxide level in ppm. The test/reset button may be used to test or reset the early warning device, as well as the lights, speaker and numerical display.

With respect to "low" oxygen indications, the early warning device is configured such that "low" oxygen level indications will not be produced when the heater is turned off or when the heater is in the process of being turned off or on.

The early warning device 94 and speaker 34 may be configured such that the speaker acts as a simple buzzer in the event of a "low" oxygen level, high carbon monoxide level or gas leak. A voice simulation chip may also be included in the early warning device. Here, the speaker 34 could be used to emit phrases such as "the oxygen level is low," "the carbon monoxide level is high" and "there is a gas leak."

Although the present invention has been described in terms of the preferred embodiment above, numerous modifications and/or additions to the above-described preferred embodiments would be readily apparent to one skilled in the art. By way of example, but not limitation, the present invention may be incorporated in heaters which do not have a thermostatic control system. The "unsafe," "low" and "normal" oxygen level percentages discussed above may be varied if desired. It is intended that the scope of the present invention extends to all such modifications and/or additions and that the scope of the present invention is limited solely by the claims set forth below.

What is claimed is:

1. A heater for use in an environment containing air, the air defining an oxygen content, the heater comprising:

a housing defining an interior and an exterior;

a heating assembly adapted to receive fuel from a fuel source and including at least one burner adapted to burn the fuel and a pilot adapted to produce a pilot flame movable between three spaced predetermined locations which correspond to the oxygen level in the environment in which the heater is used;

an oxygen level detection assembly adapted to distinguish between at least three predetermined oxygen levels of the air in the environment in which the heater is used by determining which one of the three predetermined locations that the pilot flame is located in, the first oxygen level corresponding to a relatively normal oxygen content, the second oxygen level corresponding to a relatively low oxygen content and the third oxygen level corresponding to a relatively unsafe oxygen content;

a carbon monoxide sensor adapted to determine the level of carbon monoxide in the air in the environment in which the heater is used;

a combustible gas sensor adapted to detect the presence of combustible gas in the air in the environment in which the heater is used; and an indicator adapted to produce at least one of an audible indication and a visible indication in response to at least one of a detection of the second oxygen level by the oxygen level detection assembly, a detection of a predetermined level of carbon monoxide by the carbon monoxide sensor, and a detection of combustible gas by the combustible gas sensor.

2. A heater as claimed in claim 1, wherein the fuel is propane.

3. A heater as claimed in claim 1, wherein the fuel is natural gas.

4. A heater as claimed in claim 1, wherein the at least one burner comprises a plurality of burners.

5. A heater as claimed in claim 1, wherein the heating assembly comprises a pilot system including a gas nozzle and an ignitor adapted to produce a pilot flame, and wherein the oxygen level detection assembly includes first and second flame sensors disposed in respective predetermined spaced relations to the to the gas nozzle and ignitor.

6. A heater as claimed in claim 1, further comprising:

a valve adapted to block the flow of fuel to the heating assembly in response to a detection of the third oxygen level by the oxygen level detection assembly.

7. A heater as claimed in claim 1, wherein the indicator comprises a plurality of lights and a speaker mounted on the exterior of the housing.

8. A heater, comprising:

a pilot having a nozzle;

an ignitor having an ignition electrode located in spaced relation to the nozzle;

a first temperature sensitive flame detector positioned in a first predetermined location in spaced relation to the pilot and ignitor; and a second temperature sensitive flame detector positioned in a second predetermined location in spaced relation to the pilot and ignitor.

9. A heater, comprising:

a pilot having a nozzle;

an ignitor having an ignition electrode located in spaced relation to the nozzle;

a first flame detector positioned substantially between the pilot and the ignitor and facing a first side of the ignition electrode; and a second flame detector positioned in a second predetermined location in spaced relation to the pilot and ignitor and associated with a second side of the ignition electrode.

10. A heater as claimed in claim 8, wherein at least one of the first and second flame detectors comprises a thermocouple.

11. A heater as claimed in claim 8, wherein the ignition electrode is substantially L-shaped.

12. A heater as claimed in claim 8, wherein the ignition electrode defines a first portion extending substantially perpendicularly to the pilot and a second portion extending substantially perpendicularly to the first portion and towards the pilot.

13. A heater as claimed in claim 8, wherein the pilot defines a longitudinal axis which passes through the nozzle and the ignition electrode intersects the longitudinal axis.

14. A heater as claimed in claim 13, wherein portions of the ignition electrode are respectively located on both sides of the longitudinal axis.

15. A heater, comprising:

a pilot having a nozzle;

an ignitor having an ignition electrode located in spaced relation to the nozzle;

a first flame detector positioned in a first predetermined location in spaced relation to the pilot and ignitor; and a second flame detector positioned in a second predetermined location in spaced relation to the pilot and ignitor;

wherein the nozzle, ignition electrode, first flame detector, and second flame detector are respectively located such that a flame produced by the pilot will remain in a substantially fixed position, for a predetermined period of time, in response to an oxygen level substantially equal to approximately between 19.2% and 19.0%, the substantially fixed position being one in which the first flame detector will not detect a flame and the second flame detector will detect a flame.

16. A heater as claimed in claim 15, wherein the predetermined period of time is substantially between approximately 8 and 15 minutes.

17. A heater as claimed in claim 8, further comprising:

an indicator operably connected to the first flame detector, the indicator being adapted to produce at least one of an audible indication and a visible indication that an oxygen level is relatively low in response to a failure by the first flame detector to detect a flame.

18. A heater as claimed in claim 8, further comprising:

a valve operably connected to the pilot, a gas source and the second flame detector, the valve being adapted to close in response to a failure by the second flame detector to detect a flame.

19. A heater for use in an environment containing air, the heater comprising:

a housing defining an interior and an exterior, the interior of the housing defining an upper portion, a lower portion substantially separated from the upper portion, at least one air outlet associated with the upper portion and at least one air inlet associated with the lower portion;

a heating assembly located within the upper portion of the interior and adapted to receive fuel from a fuel source and including at least one burner adapted to burn the fuel;

a carbon monoxide sensor located substantially within the lower portion of the interior and adapted to determine the level of carbon monoxide in the air in the environment in which the heater is used; and an indicator operably connected to the carbon monoxide sensor, the indicator being adapted to produce at least one of an audible indication and a visible indication in response to a detection of a predetermined level of carbon monoxide by the carbon monoxide sensor.

20. A heater as claimed in claim 19, wherein the indicator is associated with the exterior of the housing.

21. A heater as claimed in claim 19, wherein the indicator comprises a numerical display.

22. A heater as claimed in claim 19, wherein the upper portion and lower portion are substantially separated by a plate.

23. A heater as claimed in claim 19, further comprising:

a combustible gas sensor operably connected to the indicator and adapted to detect the presence of combustible gas in the air in the environment in which the heater is used;

wherein the indicator is adapted to produce at least one of an audible indication and a visible indication in response to at least one of a detection of a predetermined level of carbon monoxide by the carbon monoxide sensor and a detection of combustible gas by the combustible gas sensor.

24. A heater for use in an environment containing air, the heater comprising:

a housing defining an interior and an exterior, the interior of the housing defining an upper portion, a lower portion substantially separated from the upper portion, at least one air outlet associated with the upper portion and at least one air inlet associated with the lower portion;

a heating assembly located within the upper portion of the interior and adapted to receive fuel from a fuel source and including at least one burner adapted to burn the fuel;

a combustible gas sensor located within the lower portion of the interior and adapted to detect the presence of combustible gas in the air in the environment in which the heater is used; and an indicator operably connected to the combustible gas sensor, the indicator being adapted to produce at least one of an audible indication and a visible indication in response to a detection of combustible gas by the combustible gas sensor.

25. A heater as claimed in claim 24, wherein the indicator is associated with the exterior of the housing.

26. A heater as claimed in claim 24, wherein the indicator comprises a numerical display.

27. A heater as claimed in claim 24, wherein the upper portion and lower portion are substantially separated by a plate.

28. A heater as claimed in claim 1, wherein the oxygen level detection assembly comprises first and second thermocouples located in spaced relation to one another.

29. A heater as claimed in claim 8, wherein the first and second flame detectors respectively comprise first and second thermocouples.

* * * * *